US007251419B2

(12) United States Patent
Silvestri et al.

(10) Patent No.: US 7,251,419 B2
(45) Date of Patent: Jul. 31, 2007

(54) EFFECTIVE SURFACE RESISTIVITY THROUGH IMAGE ANALYSIS

(75) Inventors: Markus R. Silvestri, Fairport, NY (US); Kenny-Tuan T. Dinh, Webster, NY (US); Surendar Jeyadev, Rochester, NY (US); Gary A. Batt, Fairport, NY (US); Dale S. Renfer, Webster, NY (US)

(73) Assignee: Xerox Corporation, Stamford, CT (US)

( * ) Notice: Subject to any disclaimer, the term of this patent is extended or adjusted under 35 U.S.C. 154(b) by 176 days.

(21) Appl. No.: 11/158,820

(22) Filed: Jun. 22, 2005

(65) Prior Publication Data

US 2006/0291877 A1 Dec. 28, 2006

(51) Int. Cl.
*G03G 15/00* (2006.01)
*G03G 21/00* (2006.01)

(52) U.S. Cl. ..... 399/26; 399/49

(58) Field of Classification Search ..... 399/26, 399/46, 48, 49; 347/19; 358/406, 504
See application file for complete search history.

(56) References Cited

U.S. PATENT DOCUMENTS 5,457,519 A * 10/1995 Morrison et al. ..... 399/26
6,006,047 A * 12/1999 Mara et al. ..... 399/49

OTHER PUBLICATIONS

Weiss et al., "Analysis of Electrostatic Latent Image Blurring Caused by Photoreceptor Surface Treatments," J. of Imaging Science and Tech., vol. 40, No. 4, pp. 322-326, (1996).
Yi et al., "Numerical Simulation of the Lateral Conductivity of a Photoconductor Surface," J. of Imaging Science and Tech., vol. 48, No. 4, pp. 294-305, (2004).

* cited by examiner

*Primary Examiner*—Sophia S. Chen
(74) *Attorney, Agent, or Firm*—Fay Sharpe LLP

(57) ABSTRACT

A method for determining the approximate surface conductivity of a photoreceptor surface. The method involves forming a latent image of a series of lines of different widths on the surface, developing the image, and then printing the image. Based on which lines print, the surface conductivity can be computed once the developability of isolated lines is established through a calibration procedure.

14 Claims, 8 Drawing Sheets

POTENTIAL [V]

| | MEASURED | COMPUTED | DIFFERENCE | |
|---|---|---|---|---|
| SOLID | 576 | 575.2 | -0.8 | -0.1% |
| | 659 | 655.7 | -3.3 | -0.5% |
| | 697 | 695.9 | -1.1 | -0.2% |
| | 718 | 716.0 | -2.0 | -0.3% |
| 15-BIT | 727 | 725.5 | -1.5 | -0.2% |

EFFECTIVE SURFACE RESISTIVITY THROUGH IMAGE ANALYSIS

BACKGROUND

The exemplary embodiment relates to a technique for quantifying surface resistivity or the degree of lateral charge migration (LCM) on a photoconductor surface.

Distortion, loss, or decay of latent images on a photoreceptor surface are detrimental to the quality of a final image carried on the photoreceptor. If the electrostatic latent image changes during the time between formation of the image and application of toner, the resulting final image can deviate significantly from the initial exposed image.

A major factor leading to such distortion, loss or decay of latent images is lateral charge migration (LCM) along a surface of the photoreceptor. If the photoreceptor surface is conductive, lateral charge migration can occur causing degradation of an electrostatic latent image retained by the photoreceptor.

In order to address this problem and provide strategies and materials for limiting or reducing the extent of LCM on a photoreceptor surface, it would be beneficial to identify a technique for quantifying LCM or rather, surface conductivity of the photoreceptor surfaces.

Attempts have been made by artisans to analyze electrostatic latent image blurring. And attempts in providing numerical simulations of lateral conductivities have been proposed to serve as models for further investigation. Although satisfactory in many respects, a need remains for a technique and method for readily identifying and ideally, quantifying, LCM or surface conductivity value of a photoreceptor surface.

Additionally, external agents can detrimentally affect photoreceptor life by promoting LCM or inducing LCM. Depending on the level of exposure and aggressiveness of the external agents such as corona effluents or amine salts, LCM can be induced in as little as a few prints. Accordingly, it would be beneficial to readily determine the extent of LCM so that strategies may be better formulated to reduce the effects from external agents.

BRIEF DESCRIPTION

In a first aspect, the exemplary embodiment provides a method for determining surface conductivity associated with a line of particular width and a photoreceptor surface. The method comprises defining an isolated line. The method also comprises determining a first average discharge potential associated with the isolated line printing using the photoreceptor surface. Also, a second average discharge potential is determined which is associated with the isolated line ceasing to print utilizing the photoreceptor surface. The method also comprises computing a first discharge potential from the first average discharge potential. The method further comprises computing a second discharge profile from the second average discharge potential. And, the method comprises identifying a third discharge profile having a known surface conductivity associated therewith. The third discharge profile has a minimum value that matches the minimum of the second discharge profile, whereby the known surface conductivity of the third discharge profile is the minimum conductivity associated with the line and the photoreceptor surface.

In another aspect, the exemplary embodiment provides a method for estimating surface conductivity of a photoreceptor. The method comprises defining a digital template including a collection of lines. Each line has a different width and a known surface conductivity associated with it. The method also comprises providing the photoreceptor whose surface conductivity is to be estimated. The method further comprises printing the digital template with the photoreceptor to form a printed image. And, the method comprises analyzing the printed image to thereby estimate a surface conductivity associated with the photoreceptor.

DETAILED DESCRIPTION

Figure 1:
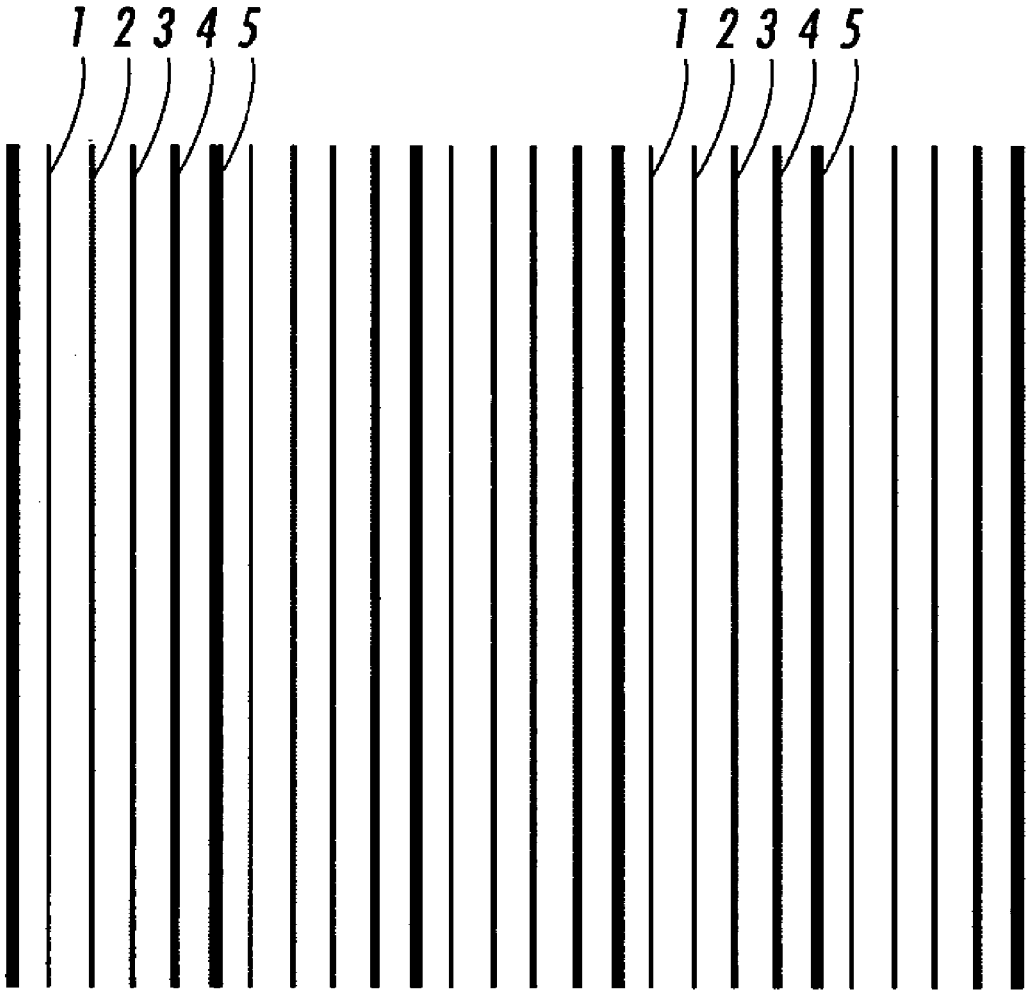
FIG. 1 is an illustration of a representative digital image template in accordance with the exemplary embodiment.

The exemplary embodiment process described herein provides a strategy for readily estimating surface conductivities of a photoreceptor so as to provide an indication of the potential for lateral charge migration, i.e. decay, of a latent image. It is contemplated that the exemplary embodiment method can be used as a tool to quickly assess whether a problem involving photoreceptor surface conductivity exists, and if so, the degree or extent of such problem.

Before describing the exemplary embodiment, it is instructive to consider the basic process for creating an electrostatic charge pattern, rendering that pattern visible also known as developing the image, and transferring the pattern to a substrate such as paper. Generally, a uniform electrostatic charge is deposited on a photoreceptor surface by a corona discharge. The photoreceptor is exposed with an optical image of the object to be reproduced. This selectively dissipates the surface charge in the exposed regions and creates a latent image in the form of an electrostatic charge pattern. Electrostatically charged toner particles are brought into contact with the latent image. The toner particles are transferred to a receiver and then fused. The remaining toner particles are removed from the photoreceptor surface. The various steps can be carried out around the periphery of a photoreceptor drum or a photoreceptor web.

More specifically, the latent image formation, image development, and transfer operations are as follows. The absorption of an image exposure by the photoreceptor creates electron-hole pairs. Under the influence of a field, a fraction of the pairs separate and are displaced to the free surface and the substrate electrode. The surface charge is thus dissipated in the exposed regions and an electrostatic charge pattern is created. For optical copiers, the image exposure is reflected from a document, then imaged onto the photoreceptor through a lens. For digital xerography, the exposures are usually derived from a semiconductor laser or an array of light-emitting diodes.

In the development step, charged toner particles are deposited on the photoreceptor surface. There are several techniques by which this can be accomplished, most of which involve the use of a second component called a carrier. Toners are comprised of a colorant in a resin binder. Depending on the application, additional components may include additives to control the charge level, surface additives to control flow and cleaning, and/or waxes to prevent toner adhesion to the fuser roller. For black and white applications, the most common colorant is carbon black. The role of the resin is to bind the toner to the receiver, thus creating a permanent image. The choice of the resin depends on the fusing process. Toner particles are usually attached to carrier particles or beads. In the literature, these are sometimes described as developers. Single-component developers are comprised only of toner particles, while two-component developers contain both toner and carrier particles. The beads are either metal, glass, or metal ferrites. The particles usually contain a thin polymer surface layer to control the toner charge. The final step in the development process involves the transfer of the toner particles from the carrier beads to the photoreceptor surface. While two-component developers are used for most applications, single-component developers have received increasing emphasis in recent years.

In the transfer step, toner particles are transferred from the photoreceptor to a receiver. The receiver is usually paper. Transfer is normally accomplished electrostatically, for example, a receiver is placed in contact with the toned image. The free surface of the receiver is then charged with a polarity opposite to the toner particles. The paper is then separated from the photoreceptor.

The exemplary embodiment provides a method to determine photoreceptor surface conductivity using image analysis of a digital image template, which can be in the form of a specific sequence of variable width lines printed with the photoreceptor. The exemplary embodiment utilizes a strategy in which a sequence of lines, each having a different width in terms of number of pixels, such as for example lines 1,2,3,4 and 5 in FIG. 1, are printed. The disappearance of lines of increasing width, as shown in examples A and B in FIG. 6, indicates the extent of LCM.

Based on the continuity equation LCM in one dimension can be described through:

$$\partial_x\left(\mu\cdot n\cdot\left\{f*\frac{\sigma}{\varepsilon}\right\}\right)+\partial_t\sigma+G\cdot\sigma^{\alpha}=0 \tag{1}$$

where σ is the surface charge density, μ is the charge carrier mobility, n the carrier density (unipolar transport assumed here), and f the photoreceptor point spread function (between lateral electric field $E_{//}$ and σ). G and α are constants. The third term is a source term to account for the dark decay. This term allows treating the problem in one or two dimensions. The other symbols have the usual meaning.

It is reasonable to assume μ and n as constant in first approximation (in respect to field and time). This assumption is experimentally validated for surfaces, contaminated with amine salts for lateral fields up to 0.5V/μm: As a result, dropping for simplicity the dark decay term, Equation (1) simplifies to:

$$\frac{g}{\varepsilon}\partial_x(f*\sigma)+\partial_t\sigma=0 \tag{2}$$

where g is a constant and may be associated with an effective surface conductivity. This equation is used for modeling and g is the constant that the exemplary embodiment measures through image analysis.

For illustrative purposes, for infinitely thin photoreceptors:

$$f=-s\cdot\partial_x\delta$$

where s is the photoreceptor thickness and equation (2) reduces to the Telegraph equation (with V=sσ/ϵ):

$$\frac{s}{\varepsilon}g\partial_x^2V-\partial_tV=0 \tag{3}$$

where V is the surface potential. LCM can be regarded as a time dependent point spread function on the latent image parameterized by the surface conductivity. The corresponding modulation transfer function (MTF) becomes for Equation (3) particularly simple:

$$MTF=e^{-\frac{sg}{\varepsilon}k^2t} \tag{4}$$

where t is the time and k the spatial frequency.

Ideally, a direct capture of the latent image is desired. However, any electrical probe will have too limited resolution (the resolution is of the order of probe-photoreceptor surface distance). As a result printed images are used.

A significant aspect of the exemplary embodiment is the digital image template that is formed as a latent image, developed, and printed to determine the surface conductivity. The digital image template includes an array of pixel lines of varying widths in terms of pixel number spaced far enough apart such that the background does not vary significantly if the surface charges spread completely. A non-limiting example of a representative digital image template is given in FIG. 1.

The exemplary embodiment can utilize a digital image template that utilizes a repeating series of lines or regions of different line widths. For example, the digital image template depicted in FIG. 1 includes a repeating series of lines of varying widths separated by white space. The first line designated as "1" has a line width of 1 pixel, the second line designated as "2" has a width of 2 pixels, and so on up to the fifth line designated as "5" that has a width of 5 pixels.

An exemplary embodiment method for assessing surface resistivity or LCM values of a photoreceptor surface is as follows. First, a printer is calibrated as described herein, for isolated lines of different widths by tuning the writing laser until the isolated lines disappear to determine the printability threshold. Next, a digital image template is printed on a test photoreceptor. The digital image template can be in the form of the exemplary digital image template depicted in FIG. 1. The parameter g, i.e. the effective surface conductivity, is then determined by equations (2) or (3) based on which lines disappeared in the print.

Figure 2:
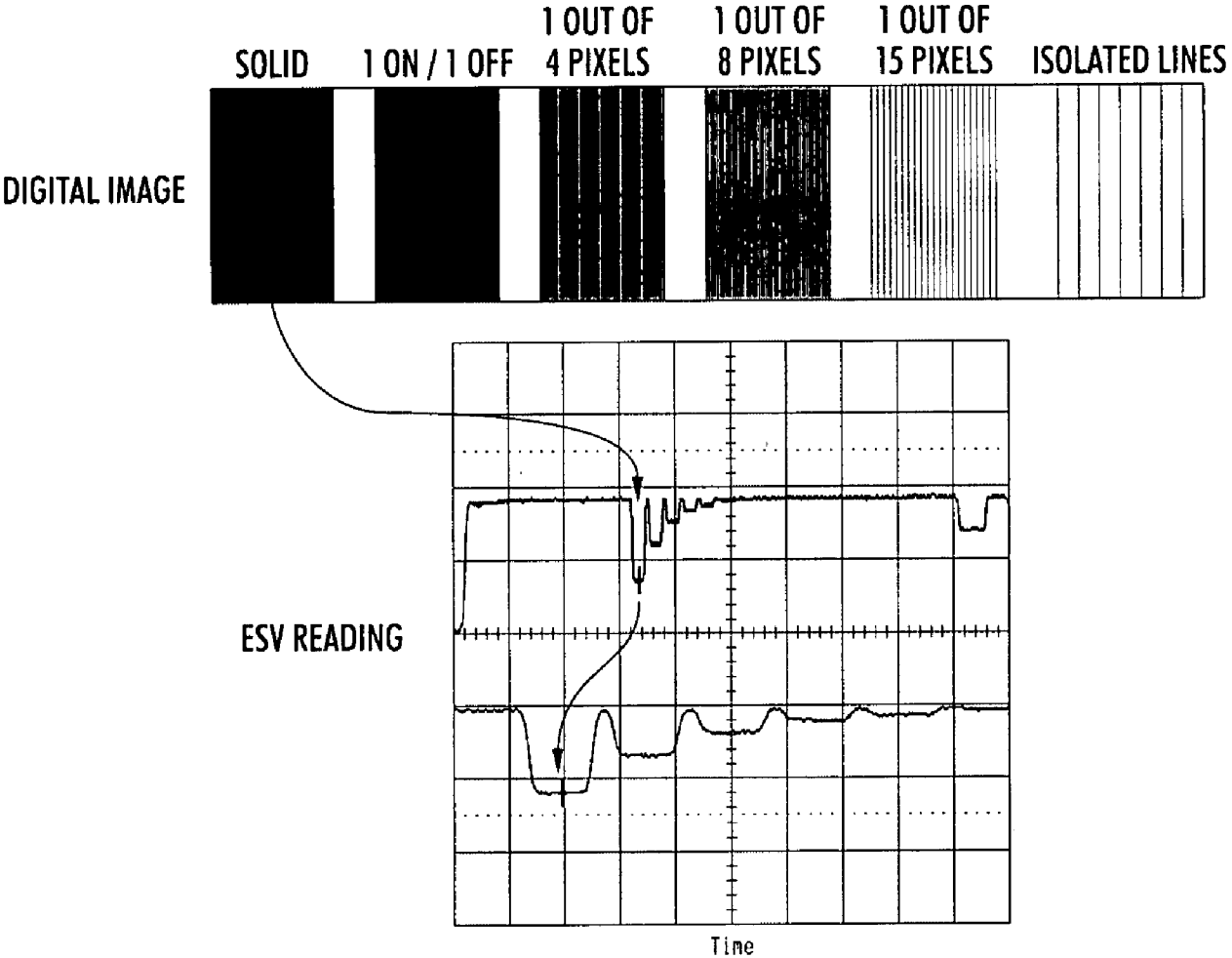
FIG. 2 is an illustration of a digital image fed to a printer and the corresponding electrostatic voltmeter (ESV) readings from the printer.

Calibration is another aspect of the exemplary embodiment. Calibration may be performed as follows. The electrostatics of the photoreceptor can be exactly computed. However, the development characteristics of the printer are generally not analytically approachable. The easiest way to identify such characteristics of a printer is to feed the printer with a digital document and read out the average discharge levels through its own electrostatic voltmeter (ESV) as shown in FIG. 2. Alternately, a commercially available ESV can be used such as for example a Trek Model 344 Electrostatic Voltmeter.

In the description of the following exemplary embodiment methods, the terms "average discharge potential" and "discharge profile" are used. "Average discharge potential" as used herein, refers to the average electrical potential of an electrostatic image along the surface of a photoreceptor. Average discharge potential can be computed as described herein or, measured by using an ESV. "Discharge profile" as used herein refers to the spatial variation of the electrical potential along the surface associated with a printed image. As such, the discharge profile of an image, or portion or segment of an image, is typically computed and any adjustable parameters such as exposure are determined from the average discharge potentials.

Figure 3:
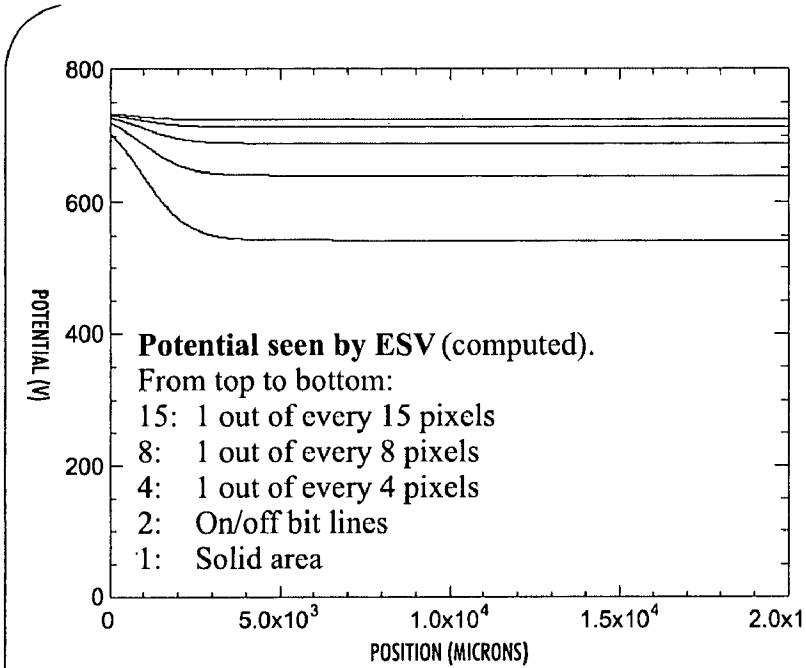
FIG. 3 is a graph of computed ESV readings as a function of position from the illustrated digital image template in FIG. 2, and a corresponding table in which the computed potentials are compared to measured potentials.
Figure 4:
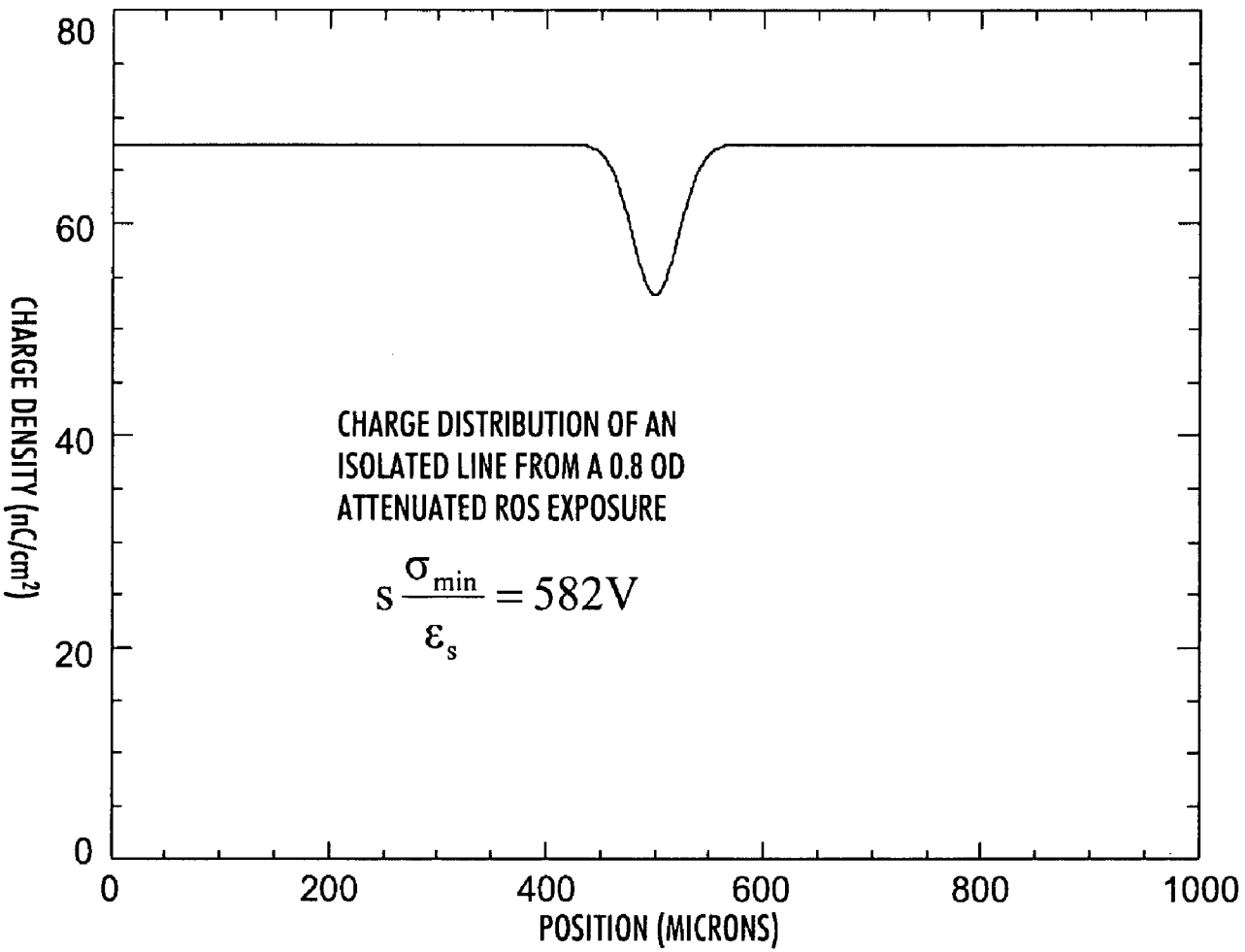
FIG. 4 is a graph of the charge distribution as a function of position for an isolated line.
Figure 5:
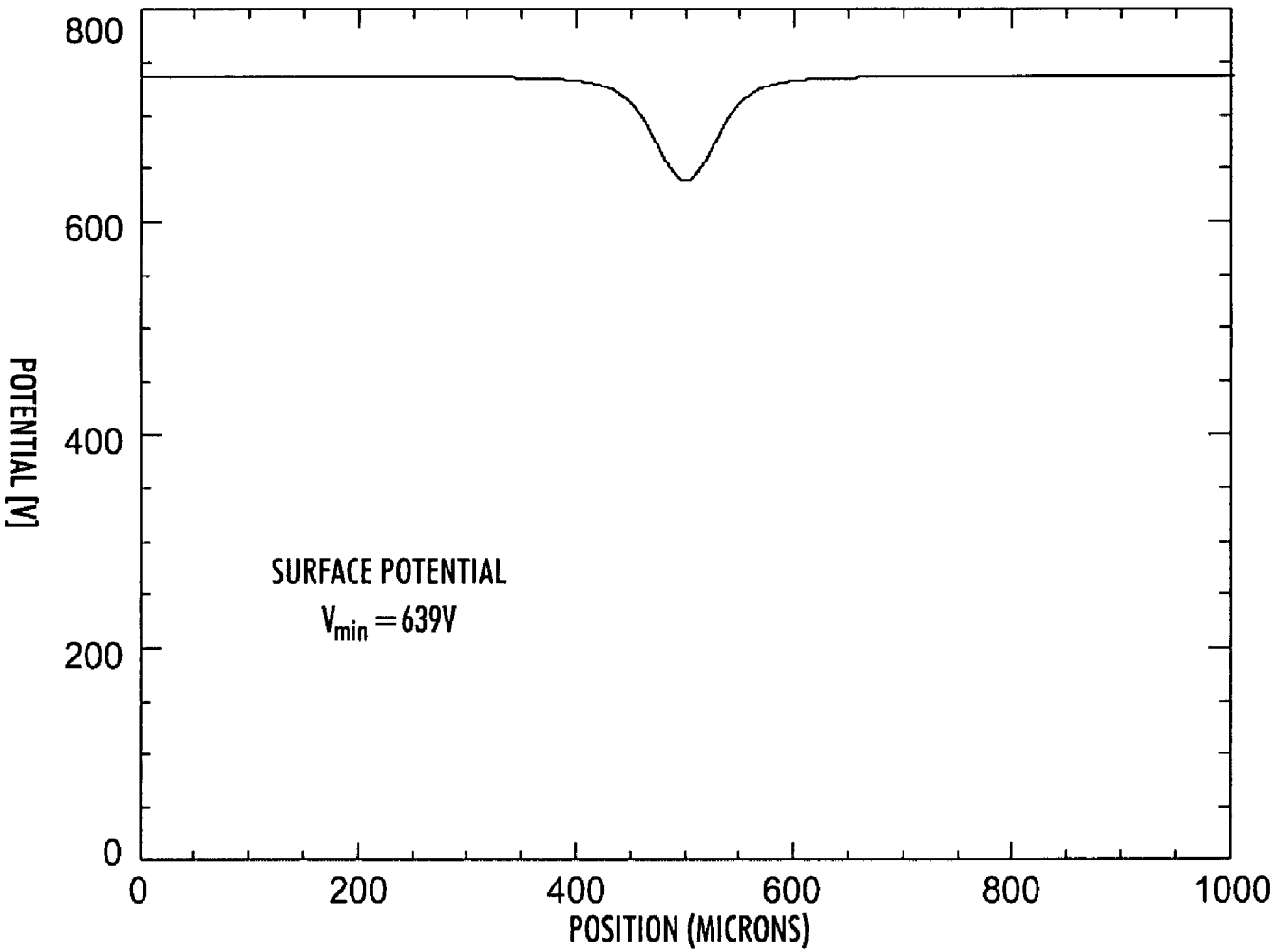
FIG. 5 is a graph of surface potential as a function of position for the line plotted in FIG. 4.

The actual discharge potential can be computed from the photo-induced discharge curve (PIDC). The average discharge potential associated with an electrostatic latent image can also be measured with an ESV. The ESV works as a simple spatial filter. If it is placed at a distance d from the surface its readout is given by:

$$V_{CE} = \left(d + \frac{\varepsilon_d}{\varepsilon_s} s\right) \cdot \int \frac{\sigma(k)}{\varepsilon_s} \frac{1}{\cosh(kd)} \frac{1}{\left(\frac{\varepsilon_d}{\varepsilon_s} + \frac{\tanh(kd)}{\tanh(ks)}\right)} \cdot e^{ikx} dk \tag{5}$$

where s is the photoreceptor thickness and σ(k) the Fourier component of the photoreceptor surface charge density. The other symbols have the usual meaning. This is based on the fact that the counter electrode of the ESV is adjusted until the field underneath it vanishes. Hence, in this example, all five readouts from the ESV in FIG. 2 can be fitted by just one adjustable parameter, the laser power. This should be done for two cases: For printer in default mode and for the case where the laser has been attenuated (e.g. by neutral density filters) to the point where the isolated one-pixel lines in FIG. 2 disappear. This process can also be repeated for isolated lines of larger widths. An example of the one-pixel line case is given in FIG. 3. The average of the resulting discharge potentials from the different patterns in FIG. 2 are measured by the ESV. Since the profile of the laser and the print patterns are known, their corresponding discharge profiles can be computed using the laser power as an adjustable parameter. This laser power may also account for effects such as unknown losses. The parameter is adjusted until good agreement between these computed and the experimental potentials are obtained. Note in FIG. 2 the good agreement for all potentials with just one adjustable parameter, the laser power. With this parameter the charge density profile of an isolated one-pixel line is computed as shown in FIG. 4 (for simplicity the laser profile was approximated by a Gaussian curve). The corresponding potential at the photoreceptor surface is shown in FIG. 5. The outcome of this analysis is that the discharge level of the isolated one-pixel line is now known in default mode and at the point when it does not print. The discharge levels are thus "pinned" and can now be used as references in the tests Generally, an exemplary embodiment calibration method is provided as follows. Calibration may be considered as determining or estimating the developability, i.e., printability of images such as isolated lines of a digital template. A digital template is defined, such as for example, that depicted in FIG. 2. An electrostatic latent image is formed on a photoreceptor surface, such as by light exposure thereon, from the digital template. The image is then printed or otherwise developed. In certain embodiments, the image is printed using a printer having an electrostatic voltmeter. The discharge potentials of the printed digital template can readily be measured using the electrostatic voltmeter. The discharge profile of one or more isolated lines is then computed, from the discharge potentials. Next, the light source used in forming the electrostatic latent image is attenuated to a point at which the one or more isolated lines, upon printing, disappear and no longer print. Typically, the attenuation is performed incrementally or reiterately. After appropriately attenuating the light source, the discharge potentials of the second printed digital template are measured. Measuring is generally performed by using the previously noted electrostatic voltmeter associated with the printer. The discharge profile of one or more of the isolated lines is computed from the second measured discharge potentials of the image template. These second measured discharge potentials determine the discharge profiles corresponding to the threshold of the developability or printability of the isolated lines.

Generally, an exemplary embodiment method for approximating surface conductivity on a photoreceptor surface is provided as follows. The method involves computing or otherwise determining a latent image of a digital template on the photoreceptor surface for different values of surface conductivity. The digital template can include a collection of lines in which at least two lines have different widths. An operation of establishing which lines print for various surface conductivity values is performed. This operation is based on the aforementioned calibration. The digital image is printed. Based upon which lines of the digital image print, and which lines do not print, the approximate surface conductivity of the photoreceptor surface can be specified.

An exemplary embodiment method for determining surface conductivity of a photoreceptor surface, and specifically, determining the upper or lower bounds of the surface conductivity, is provided as follows. Discharge profiles for one or more isolated lines of, for example, a digital template are determined as described herein in regards to calibration with a control photoreceptor that is LCM free. Specifically, a first discharge profile is computed from the average discharge potentials of the digital template for the printer default state in which an isolated line is generally printed so as to appear on a substrate. A second discharge profile is computed from the average discharge potentials of the digital template for a state in which the isolated lines cease to print out, such as a result of exposure light attenuation. Next, a series of discharge profiles are computed and plotted on the graph containing the previously noted first and second discharge profiles. The series of discharge profiles are computed from the first profile by modifying it through equation (2) for different surface conductivities. Ideally, discharge profiles (or curves) are reiteratively computed until a profile is identified of which its profile minimum (magnitude) matches or crosses the minimum of second discharge profile. An example is given in FIG. 7 where line c crosses the second discharge profile labeled as 2. The value of conductivity, i.e. g, associated with the identified curve is the minimum conductivity at which the isolated line ceases to print. This calibration procedure is repeated for lines of different widths. Each line width will have its own conductivity value $g_k$ at which it ceases to print. Each of these values provide an upper or lower limit of surface conductivity depending whether their respective lines print or not print. Next a digital template such as the one depicted in FIG. 1 is printed with a test photoreceptor with suspected LCM. If line m of width of m pixels does not print, then $g_m$ is the lower conductivity limit and if line n of width of n pixels prints, then $g_n$ is the upper conductivity limit.

Figure 6:
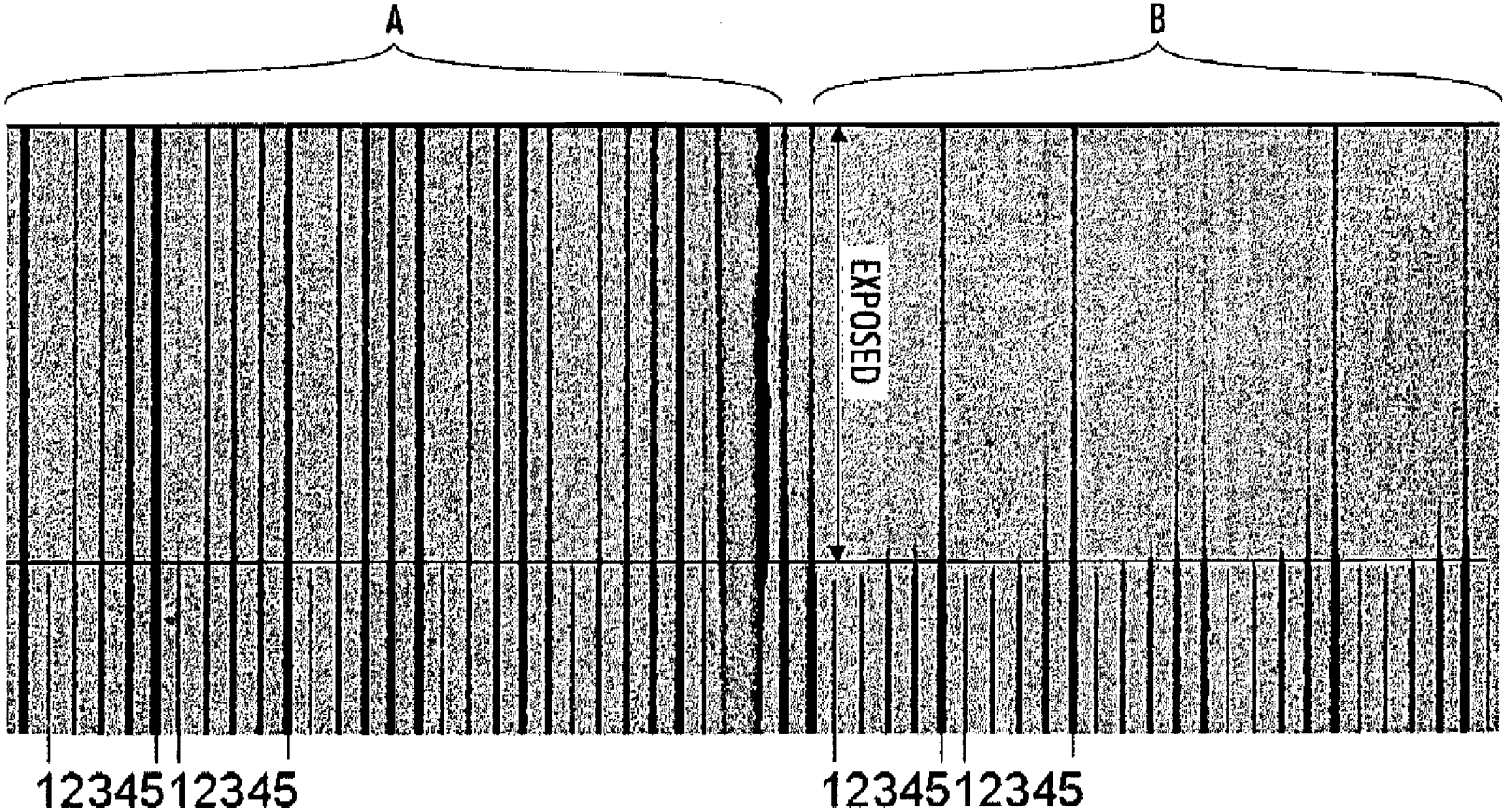
FIG. 6 is the printed version of the digital image template of FIG. 1 for two different photoreceptors A and B that were exposed to LCM inducing corona effluents.

Testing photoreceptors for LCM or surface conductivity can be accomplished as follows. Two test photoreceptors (A and B) are exposed in a selected region to corona effluents to induce LCM. The exposure can be achieved with a specially designed stationary two-wire corotron operated with an AC voltage (peak-to-peak=2 kV, 0.5 Hz) and a DC offset of 6 kV. The corona device itself is sealed against the photoreceptor. Between the corona device and the photoreceptor, a grounded grid is disposed to avoid charging up the photoreceptor. All of these procedures are undertaken to ensure a ¾ inch uniform exposure band across the photoreceptor, as shown in FIG. 6. Since only part of the photoreceptor is exposed, one has also a control on the very same device. Typical run times of exposure are about 15 minutes.

After exposure, the exposed photoreceptors are printed. The prints are shown in FIG. 6. The digital image from FIG. 1 was used. Note the two extremes: photoreceptor A has only line 1 (isolated line of a width of one pixel) wiped out and photoreceptor B has all lines but line 5 (isolated line with a width of five pixels) wiped out.

Figure 7:
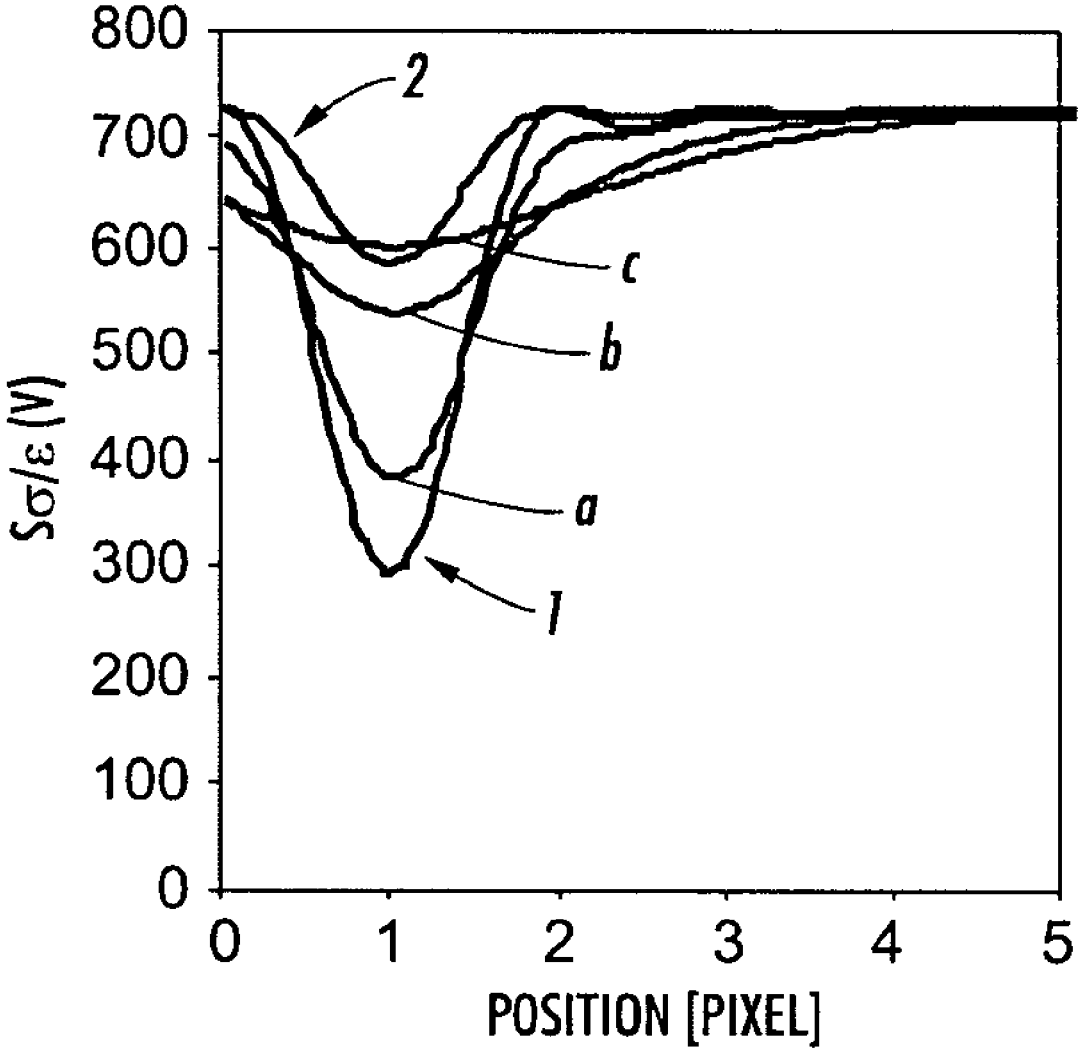
FIG. 7 is a graph of computed discharge profiles for a one pixel wide line.

Determination of the surface conductivity and thus LCM of a photoreceptor surface can be performed as follows. FIG. 7 demonstrates how the surface conductivity is determined from the prints with equation (2). Curves ① and ② were obtained for line 1 through calibration. Curve ② is the discharge profile where line 1 ceases to print out.

Next, using equation (2), a series of discharge profiles with increasing conductivities are computed until a profile matches curve ② at its minimum or lowest value. Or, more efficiently, the minimum of the computed discharge profile can be fitted to the minimum of curve ② by using the conductivity as a fitting parameter. This conductivity g, is the minimum conductivity of the associated photoreceptor surface where the one-pixel line does not print.

For example, referring to FIG. 7, a family of curves a, b, and c corresponding to the conductivities of $10^{-15}$, $5\times10^{-15}$, and $10^{-14}$ Siemens-sq are computed and plotted on the same graph as curves ① and ②. As curve c approximately intersects curve ② at its minimum, one can thereby conclude since experimentally curve ② does not print, curve c should not print either; hence, $10^{-14}$ Siemens-sq is the minimum conductivity for photoreceptor A.

Equally, one can also determine the upper bound or maximum of the surface conductivity. Again one applies equation (2) to the line that just prints by varying the surface conductivity as a parameter until the minimum of the profile crosses the threshold. This conductivity is the maximum conductivity of the associated photoreceptor surface where the two-pixel line prints.

Figure 8:
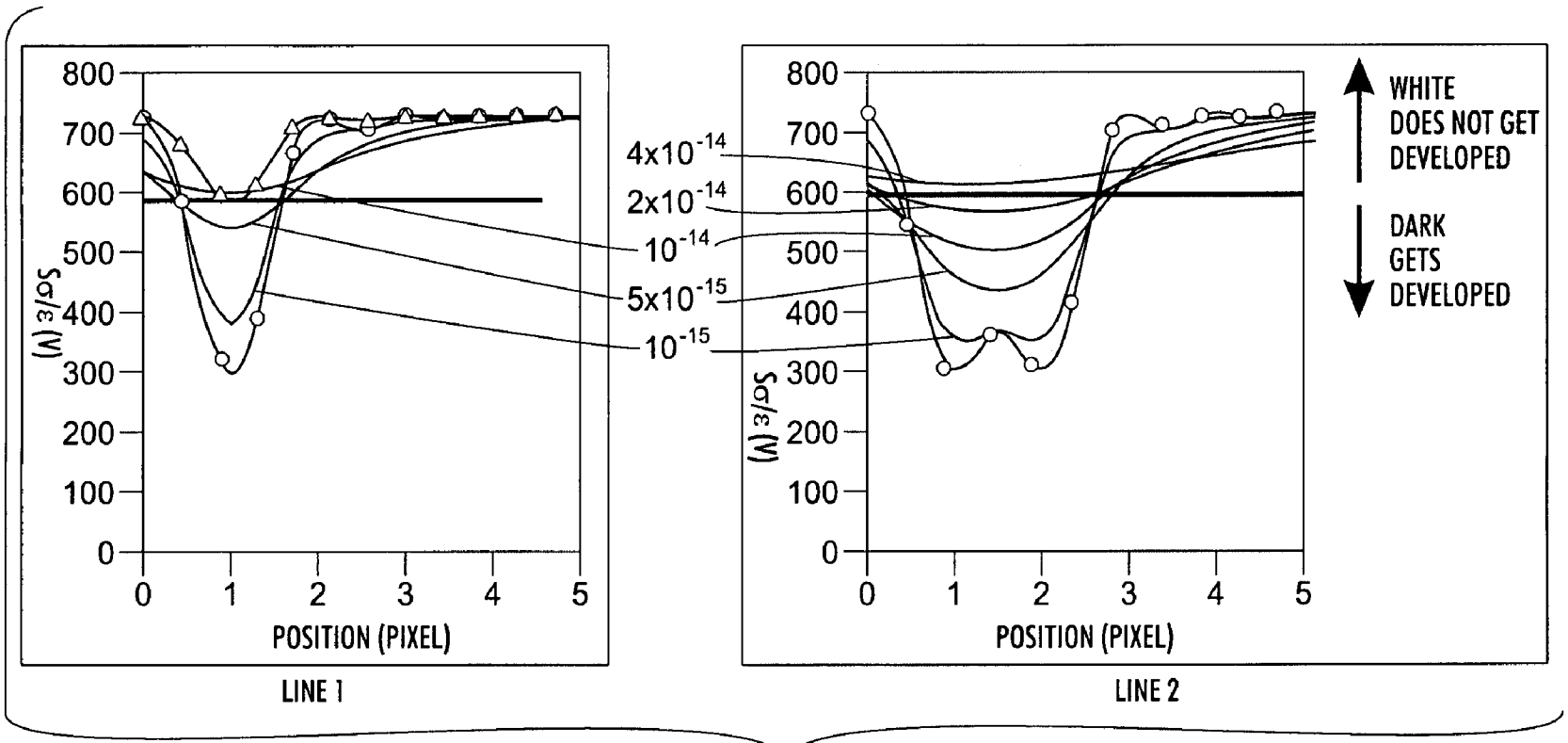
FIG. 8 illustrates the profiles of a one-pixel width line depicted in FIG. 7 along with another set of profiles of a two-pixel line.

For example, in FIG. 6, the line of a width of two pixels on photoreceptor A still prints. Referring to FIG. 8, a line of width of two pixels should print on a photoreceptor with conductivity of $2\times10^{-14}$ Siemens-sq but not for $4\times10^{-14}$ Siemens-sq; hence, it can be concluded that the upper bound of the surface conductivity is about $3\times10^{-14}$ Siemens-sq. In combination with the lower limit of $10^{-14}$ it can be then concluded that the photoreceptor conductivity lies somewhere between $10^{-14}$ and $3\times10^{-14}$ Siemens-sq.

It is to be understood that the present exemplary embodiment is not limited to using the specific digital image template described herein. The exemplary embodiment includes a digital image template of a single lines of varying widths as shown in FIG. 1. Alternately, digital images with dots of varying sizes or line segments that allow higher accuracy due to their higher sensitivity to LCM can be used.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method for determining surface conductivity associated with a line of: particular width and a photoreceptor surface, the method comprising:

defining first isolated line;

determining a first average discharge potential associated with the first isolated line printing utilizing the photoreceptor surface, and a second average discharge potential associated with the first isolated line ceasing to print utilizing the photoreceptor surface;

computing a first discharge profile from the first average discharge potential; computing a second discharge profile from the second average discharge potential; and identifying a third discharge profile having a known surface conductivity associated therewith, the third discharge profile having a minimum value that matches the minimum of the second discharge profile, whereby the known surface conductivity of the third discharge profile is the minimum conductivity associated with the first isolated line and the photoreceptor surface.

2. The method of claim 1 wherein the determining operation comprises: providing a printer having the photoreceptor surface and an electrostatic voltmeter for measuring average discharge potential; printing the first isolated line with the printer and measuring the first average discharge potential of the first isolated line for the printer being in a first default state in which the first isolated line prints and appears on a substrate; and printing the first isolated line with the printer and measuring the second average discharge potential of the first isolated line for the printer being in a second state in which the first isolated line ceases to print.

3. The method of claim 2 wherein the second state of the printer is attained by exposing the photoreceptor surface to attenuated light.

4. The method of claim 1 wherein identifying the third discharge profile comprises: plotting the second discharge profile on a graph; estimating a series of surface conductivity values and computing a series of discharge profiles, each computed discharge profile corresponding to one of the surface conductivity values of the series of surface conductivity values; and plotting the series of discharge profiles on the graph containing the second discharge profile.

5. The method of claim 4 further comprising: plotting the first discharge profile on the graph.

6. The method of claim 5 further comprising:

defining a second isolated line having a width different than the width of the first isolated line;

determining a third average discharge potential associated with the second isolated line printing utilizing the photoreceptor surface, and a fourth average discharge potential associated with the second isolated line ceasing to print utilizing the photoreceptor surface:

computing a third discharge profile from the third average discharge potential; computing a fourth discharge profile from the fourth average discharge potential; and identifying a fifth discharge profile having a known surface conductivity associated therewith, the fifth discharge profile having a minimum value that matches the minimum of the fourth discharge profile, whereby the known surface conductivity of the fifth discharge profile is the minimum conductivity associated with the second isolated line and the photoreceptor surface.

7. The method of claim 6 further comprising:

defining a third isolated line having a width different than the widths of the first isolated line and the second isolated line;

determining a fifth average discharge potential associated with the third isolated line printing utilizing the photoreceptor surface, and a sixth average discharge potential associated with the third isolated line ceasing to print utilizing the photoreceptor surface; computing a sixth discharge profile from the fifth average discharge potential; computing a seventh discharge profile from the sixth average discharge potential; and identifying an eighth discharge profile having a known surface conductivity associated therewith, the eighth discharge profile having a minimum value that matches the minimum of the seventh discharge profile, whereby the known surface conductivity of the eighth discharge profile is the minimum conductivity associated with the third isolated line and the photoreceptor surface.

8. The method of claim 6 further comprising: defining a digital template including the first isolated line and the second isolated line, whereby the first isolated line has a known minimum surface conductivity associated with it, and the second isolated line has a known minimum surface conductivity associated with it.

9. The method of claim 8 further comprising: providing a second photoreceptor suspected of exhibiting lateral charge migration; printing the digital template using the second photoreceptor to form a printed image; analyzing the printed image to thereby estimate a surface conductivity value associated with the second photoreceptor.

10. The method of claim 9 wherein the analyzing is performed by determining which of the first isolated line and the second isolated line of the digital image, print or fail to print.

11. A method for estimating surface conductivity of a photoreceptor, the method comprising:

defining a digital template including a plurality of lines, each line having a different width and a known surface conductivity associated with it;

providing the photoreceptor whose surface conductivity is to be estimated;

printing the digital template with the photoreceptor to form a printed image; and analyzing the printed image to thereby estimate a surface conductivity associated with the photoreceptor.

12. The method of claim 11 wherein the analyzing is performed by assessing which lines of the plurality of lines of the printed digital template did not print, the method further comprising:

identifying the known surface conductivity associated with the line(s) that did not print; and selecting the surface conductivity of the line having the greatest width which did not print, which approximates a minimum surface conductivity value for the photoreceptor.

13. The method of claim 12 further comprising:

identifying the surface conductivity of the line having the smallest width which did print, which approximates a maximum surface conductivity value for the photoreceptor.

14. The method of claim 11 wherein the digital template is defined by, for each line of the plurality of lines, (i) determining a first average discharge potential associated with the line printing and a second average discharge potential associated with the line ceasing to print, (ii) computing a first discharge profile from the first average discharge potential, (iii) computing a second discharge profile from the second average discharge potential, and (iv) identifying a third discharge profile having a known surface conductivity associated therewith, which has a minimum value that matches the minimum of the second discharge profile, whereby the known surface conductivity is the conductivity associated with the line.

* * * * *